US011085648B2

(12) United States Patent
DeYoung

(10) Patent No.: US 11,085,648 B2
(45) Date of Patent: Aug. 10, 2021

(54) MOTORIZED CABLE LATCH FOR A COOKING OVEN

(71) Applicant: HTI Technology and Industries, Inc., La Vergne, TN (US)

(72) Inventor: Roger L. DeYoung, Franklin, TN (US)

(73) Assignee: HTI TECHNOLOGY AND INDUSTRIES, INC., La Vergne, TN (US)

( * ) Notice: Subject to any disclaimer, the term of this patent is extended or adjusted under 35 U.S.C. 154(b) by 0 days.

(21) Appl. No.: 16/884,472

(22) Filed: May 27, 2020

(65) Prior Publication Data

US 2020/0284440 A1 Sep. 10, 2020

Related U.S. Application Data

(63) Continuation-in-part of application No. 16/015,477, filed on Jun. 22, 2018, now Pat. No. 10,720,812.

(60) Provisional application No. 62/528,780, filed on Jul. 5, 2017.

(51) Int. Cl.
*F24C 15/02* (2006.01)
*E05B 47/00* (2006.01)

(52) U.S. Cl.
CPC ..... *F24C 15/023* (2013.01); *E05B 47/0012* (2013.01); *E05B 2047/0016* (2013.01); *E05B 2047/0024* (2013.01); *E05B 2047/0054* (2013.01); *E05Y 2201/42* (2013.01); *E05Y 2201/638* (2013.01); *E05Y 2201/654* (2013.01); *E05Y 2900/308* (2013.01)

(58) Field of Classification Search
CPC .. F24C 15/023; F24C 15/022; E05B 47/0012; E05B 47/023; E05B 2047/0016; E05B 2047/0024; E05B 2047/0054; E05B 2047/0068; E05B 53/003; E05Y 2201/638; E05Y 2201/654; E05Y 2201/42; E05Y 2900/308; E05C 5/04
See application file for complete search history.

(56) References Cited

U.S. PATENT DOCUMENTS 1,458,122 A 7/1984 Knight
7,556,033 B2 * 7/2009 Kim ..... F24C 15/022 126/197
7,649,148 B2 1/2010 Pearson et al.
9,054,440 B2 6/2015 Taylor et al.
(Continued)

*Primary Examiner* — Emily P Pham
(74) *Attorney, Agent, or Firm* — Emerson, Thomson & Bennett, LLC; Roger D. Emerson

(57) ABSTRACT

Provided is a door latch including a latch mechanism, secured to an appliance such as a self-cleaning oven, which locks an appliance door to the appliance. The latch mechanism includes a latch bracket mounted to a surface of the appliance. A latch hook is mounted within the latch bracket for reciprocal movement between locking and unlocking positions. The latch hook pivotally engages a receptacle mounted on the door, to lock the door to the appliance. A flexible cable is retained inside a flexible conduit. A first end of the flexible cable is connected to the latch hook for displacing the latch hook into the locking position for pivotal engagement with the receptacle. An electric actuator is connected to a second end of the flexible cable for producing operative movement of the flexible cable within the flexible conduit to displace the latch hook between the locking and unlocking positions.

11 Claims, 17 Drawing Sheets

(56) References Cited

U.S. PATENT DOCUMENTS

| | | | | |
|---|---|---|---|---|
| 9,822,004 | B2 * | 11/2017 | Barton | C01B 3/02 |
| 2009/0139286 | A1 * | 6/2009 | Kishimoto | F24C 15/022 70/277 |
| 2012/0241470 | A1 | 9/2012 | Snodgrass et al. | |
| 2017/0145613 | A1 * | 5/2017 | Choi | E05B 17/2007 |
| 2018/0017267 | A1 * | 1/2018 | Raggi | F24C 15/022 |
| 2019/0301203 | A1 * | 10/2019 | Shin | E05F 1/1261 |

* cited by examiner

MOTORIZED CABLE LATCH FOR A COOKING OVEN

CROSS-REFERENCE TO RELATED APPLICATIONS

This application is a Continuation-In-Part of U.S. patent application Ser. No. 16/015,477, filed on Jun. 22, 2018, which claims the benefit of U.S. provisional patent application Ser. No. 62/528,780, filed on Jul. 5, 2017, which are all incorporated herein by reference.

1. BACKGROUND

A. Technical Field

This invention pertains to the field of latches used to secure an appliance door in a closed position. In particular, the invention pertains to latches for securing a cooking oven during a self-cleaning function, to prevent inadvertent opening that might pose a safety risk.

B. Description of Related Art

Many types of home cooking ovens have a self-clean function that allows the oven to heat to high temperatures to burn-off all organic residues within the oven cavity. For this function to perform its task safely, the oven door must remain closed and locked during the self-clean event. Consequently, these ovens have locking mechanisms to secure the oven door.

These oven door locking mechanisms are manufactured in four basic configurations:

1) a manually operated lever latch at the front of the oven incorporating a temperature reactive bimetal locking device;

2) a motorized oven latch mechanism at the front of the oven with latch position sensing switches;

3) a motorized oven latch that has the motor at the back of the oven with position sensing switches and a linkage system that connects to a hook mechanism at the front of the oven; and 4) a three piece latching system that has the motor mounted at the back of the oven with position sensing switches and a linkage rod traversing to the front of the oven and connecting to a pivoting latch hook assembly.

Each of these latching technologies has specific disadvantages. Manual latches are becoming less popular with appliance manufacturers due to the bulkiness and the advancement of electronic controls. Motorized front mount latches are designed to operate in a high temperature environment and therefore utilize more costly high temperature components. However, front mount latches have excellent door pull-in force. Both types of rear mounted motorized latches operate in the cooler back area of the oven, but they too are bulky and require clear pathways for the linkages to pass without operational interference. Further, rear mounted latches have less pull-in force capability due to structural limitations.

What is needed is a motorized latch mechanism that can be installed at the rear of the oven appliance or other cool operational area within the appliance and not have issues with linkage interferences with other oven componentry. Further, it should have good door pull-in force to ensure a good seal of the gasket between the door and the oven cavity opening.

II. SUMMARY

Provided in this disclosure is a door latch including a latch mechanism, secured to an appliance such as a self-cleaning oven, which locks an appliance door to the appliance. The latch mechanism includes a latch bracket mounted to a surface of the appliance. A latch hook is mounted within the latch bracket for reciprocal movement between a locking position and an unlocking position. The latch hook pivotally engages a receptacle mounted on the door, to lock the door to the appliance. A hook guide is configured to pivotally urge the latch hook into engagement with the receptacle when the latch hook is moved to the locking position. A hook return spring is configured to urge the latch hook into the unlocking position. A flexible cable is retained inside a flexible conduit. A first end of the flexible cable is connected to the latch hook for displacing the latch hook into the locking position for pivotal engagement with the receptacle. An actuator is connected to a second end of the flexible cable for producing operative movement of the flexible cable within the flexible conduit to displace the latch hook between the locking position and the unlocking position.

According to one aspect of the invention, the flexible cable and conduit of the present motorized latch can be routed (i.e., snaked) through narrow passages between inner and outer walls of the oven appliance.

According to another aspect of the invention, the present motorized latch can operate in convenient cooler operational areas of the oven appliance.

According to yet another aspect of the invention, the present motorized latch does not require clear pathways for the linkages to pass without operational interference.

According to still another aspect of the invention, the flexible conduit of the present motorized latch can protect the movement of the inner flexible cable from contact with insulation and other oven componentry.

According to a further aspect of the invention, the cable assembly can be made of materials suitable for high temperature operation without adverse operational concern and can transfer excellent door pull-in force.

According to another further aspect of the invention, small cable diameter and flexible routing options can enable an enlarged oven cavity without encroaching on the space typically assigned to linkage type latch systems.

According to yet another further aspect of the invention, the cooler operational temperatures enable incorporation of low-cost, low voltage DC motors and low cost wiring options.

Other benefits and advantages of this invention will become apparent to those skilled in the art to which it pertains upon reading and understanding of the following detailed specification.

III. BRIEF DESCRIPTION OF THE DRAWINGS

The disclosed door latch may take physical form in certain parts and arrangement of parts, embodiments of which will be described in detail in this specification and illustrated in the accompanying drawings which form a part hereof and wherein.

Figure 16:
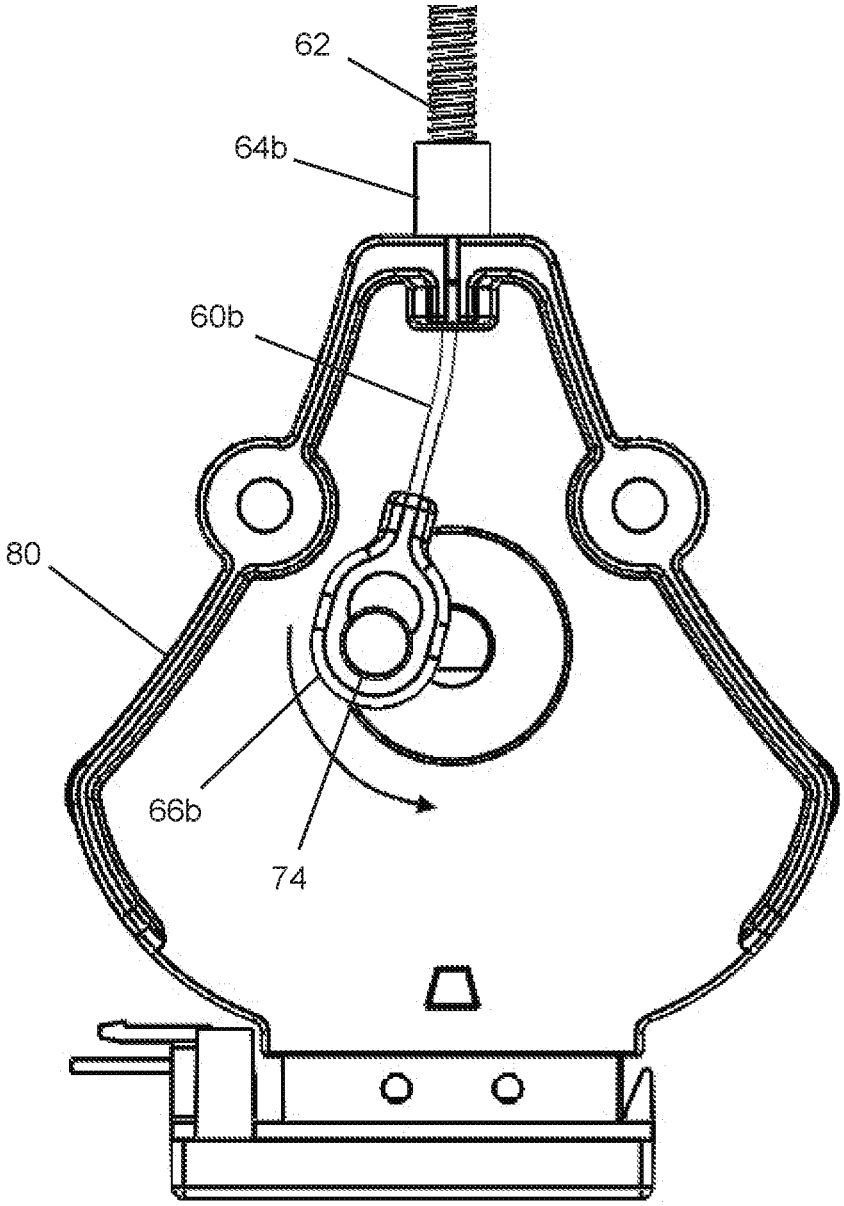
Figure 17:
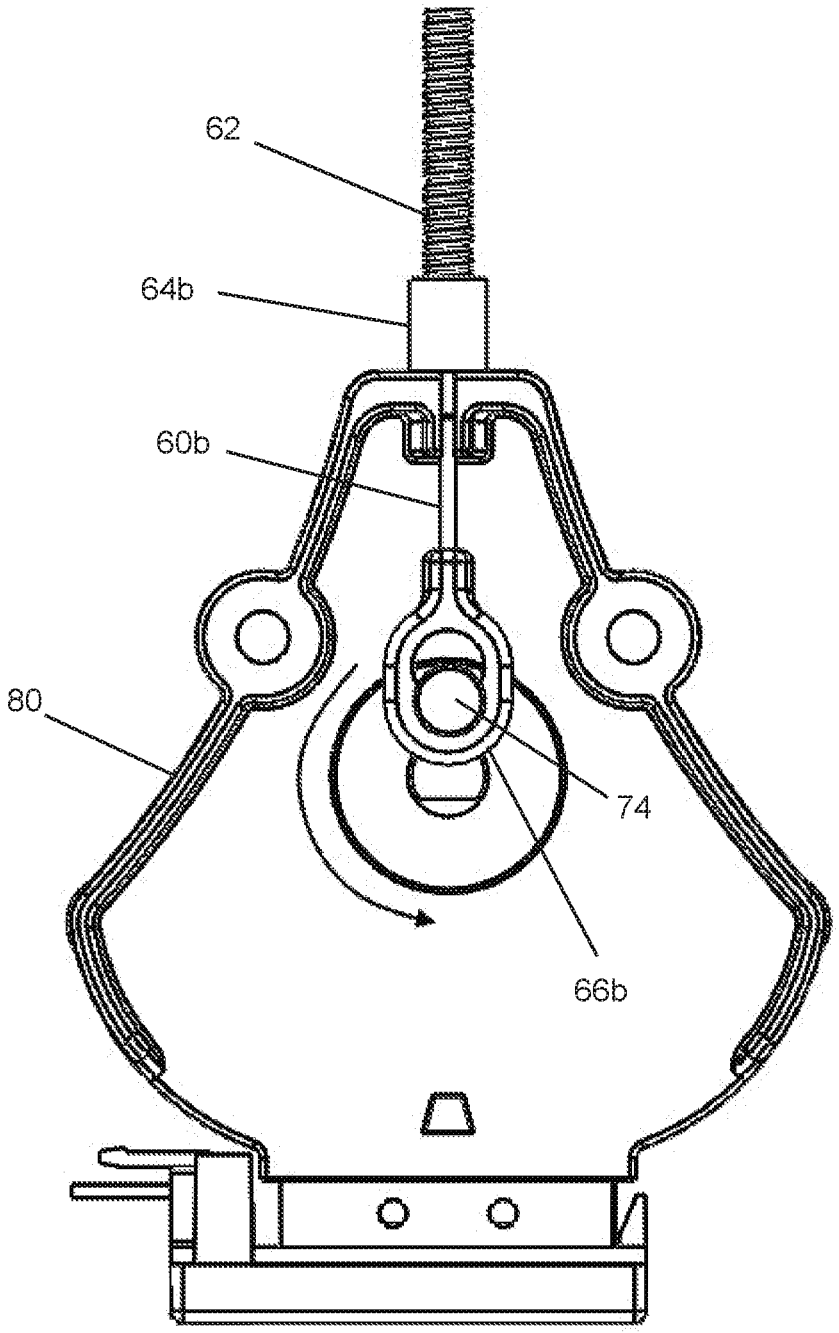

FIG. 16 is an inverted underside view of the motor bracket assembly with the motor removed and showing the rotational movement of the motorized crankshaft in accordance with an exemplary embodiment of the present invention; and FIG. 17 is an inverted underside view of the motor bracket assembly with the motor removed and showing it in the unlocking position in accordance with an exemplary embodiment of the present invention.

IV. DETAILED DESCRIPTION

Referring now to the drawings wherein the showings are for purposes of illustrating embodiments of the article only and not for purposes of limiting the same, and wherein like reference numerals are understood to refer to like components.

Figure 1:
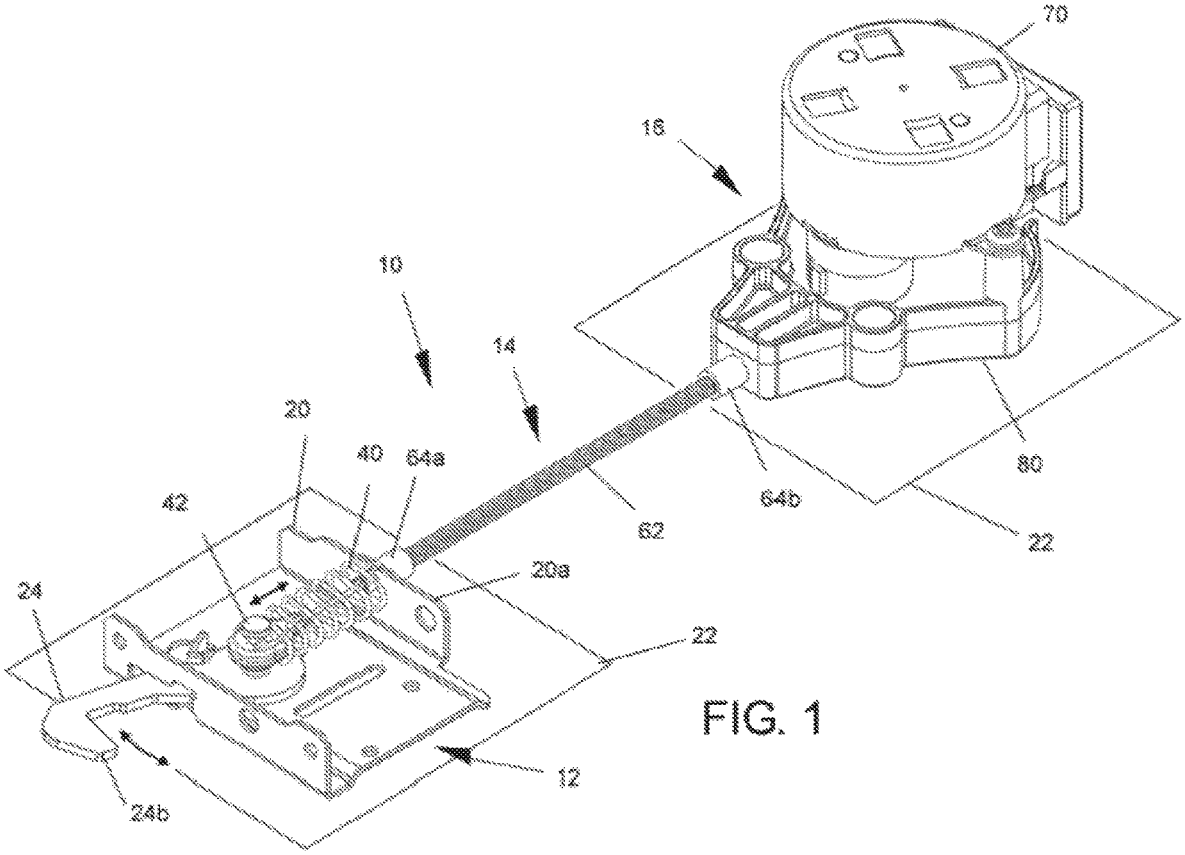
FIG. 1 is a perspective view depicting the motor and bracket assembly, cable assembly, and latch and bracket assembly in accordance with an exemplary embodiment of the present invention.
Figure 2:
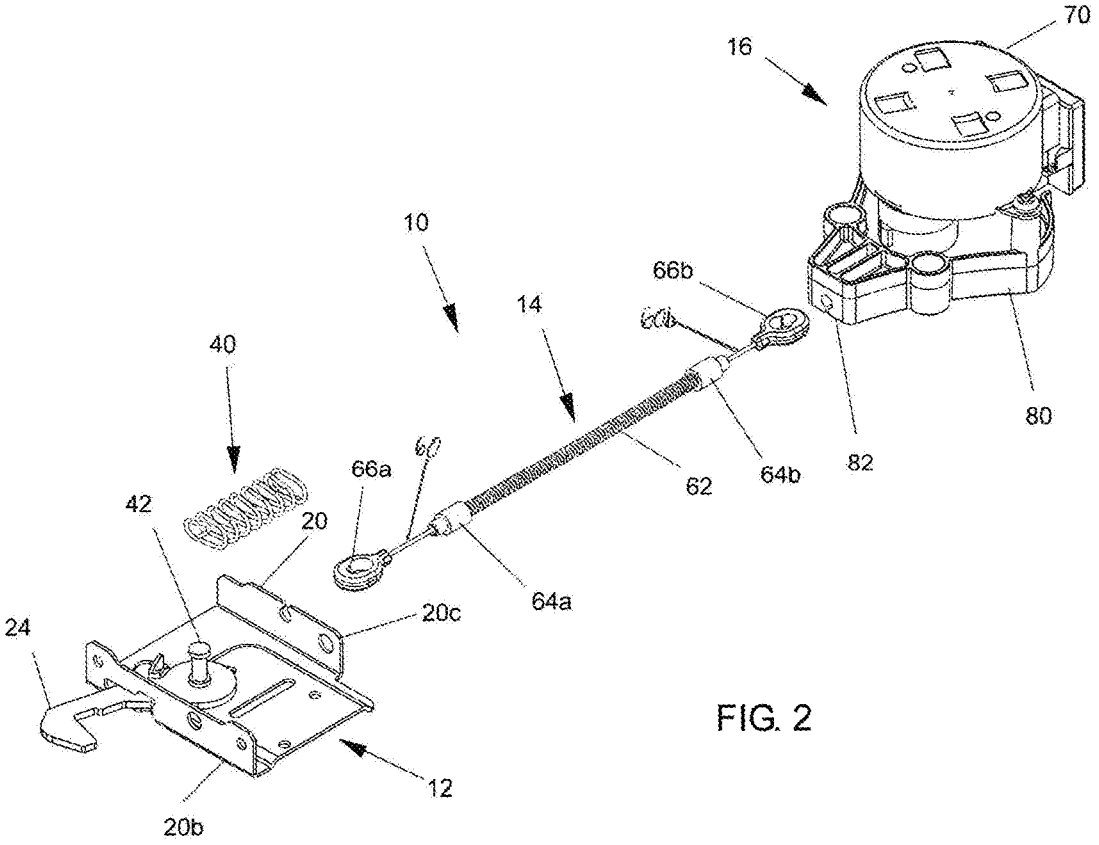
FIG. 2 is an exploded view of the motor assembly, cable assembly, and latch assembly in accordance with an exemplary embodiment of the present invention.
Figure 3:
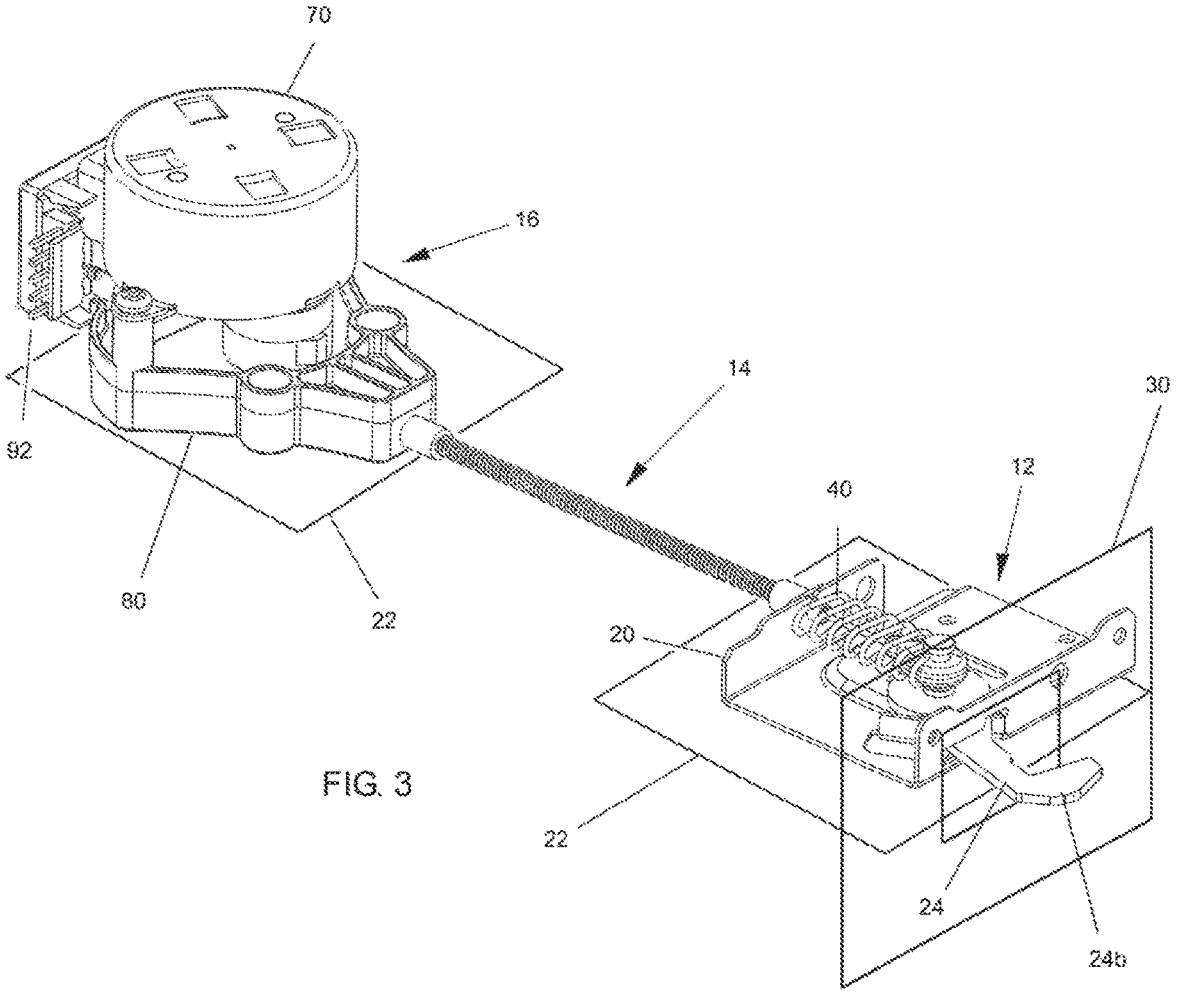
FIG. 3 is an alternate perspective view of the motor assembly, cable assembly, and latch assembly in accordance with an exemplary embodiment of the present invention.

With general reference to FIGS. 1-3, a door latch 10 is provided for securing a door to an appliance such as a self-cleaning oven. The door latch 10 generally includes a latch and hook bracket assembly including a latch mechanism 12. A cable assembly 14 connects to the latch mechanism 12 and also to a motor and bracket assembly 16. The motor and bracket assembly 16 includes an actuator that is actuated to produce a displacement in the cable assembly 14, which in turn displaces the latch mechanism 12 to secure the door to the appliance, as will be explained in detail hereinbelow.

Figure 4:
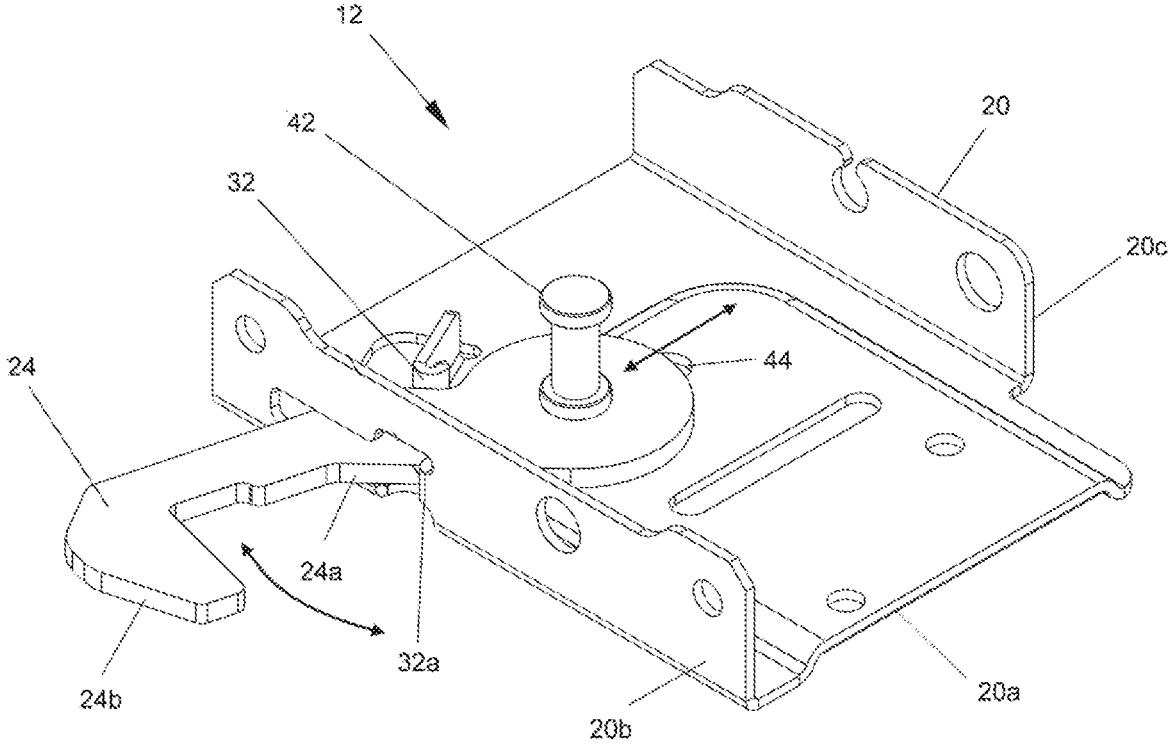
FIG. 4 is a perspective view of the latch and bracket assembly with hook guide features in accordance with an exemplary embodiment of the present invention.

As shown in FIGS. 1-3 and with special detail shown in FIG. 4, the latch mechanism 12 especially includes a latch bracket 20 mounted to a surface 22 of the appliance. The surface 22 is preferably suitably positioned on the body of the appliance to engage the door. However, alternately, the latch mechanism 12 could be located on the door to engage the body of the appliance, without departing from the invention.

With continued reference to FIGS. 1-3, a latch hook 24 is mounted within the latch bracket 20 for reciprocal movement between a locking position and an unlocking position. As shown especially in FIG. 1, a reversible arrow shows the direction of the reciprocal, back-and-forth movement of the latch hook 24 in response to movement from the cable assembly 14. As is evident from FIG. 1, the reciprocal movement displaces the latch hook 24 in either toward the cable assembly 14 or away from the cable assembly 14. As a result of this reciprocal movement, the latch hook 24 is configured to pivot along a pivoting axis so as move from side-to-side as indicated by a reversible arrow in a direction generally perpendicular to the direction of reciprocal movement, as will be explained in greater detail hereinbelow. In this manner, the latch hook 24 pivotally engages a receptacle 30 mounted on the door (FIG. 3), to lock the door to the appliance.

With particular reference to FIG. 4, the latch mechanism 12 also includes a hook guides 32 and 32*a* configured to pivotally urge the latch hook 24 into engagement with the receptacle 30 when the latch hook 24 is moved to the locking position. In the preferred embodiment, the hook guides 32 and 32*a* are mounted to the latch bracket 20 at a position to contact the latch hook 24 during reciprocal movement to the locking position, to pivotally urge the latch hook 24 into engagement with the receptacle 30.

Figure 11:
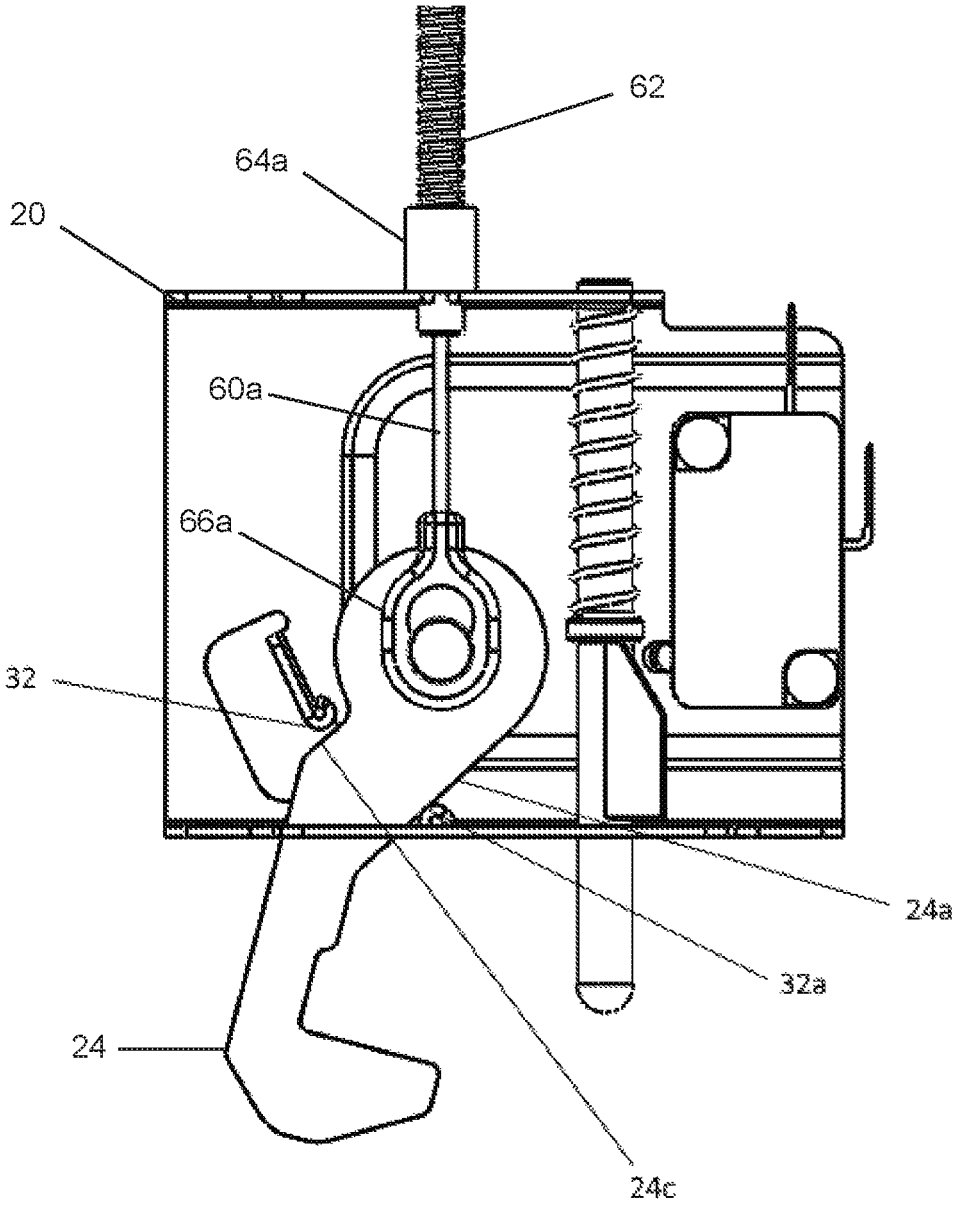
FIG. 11 is a perspective view of the latch and bracket assembly with hook guide features in an unlocking position in accordance with an exemplary embodiment of the present invention.
Figure 12:
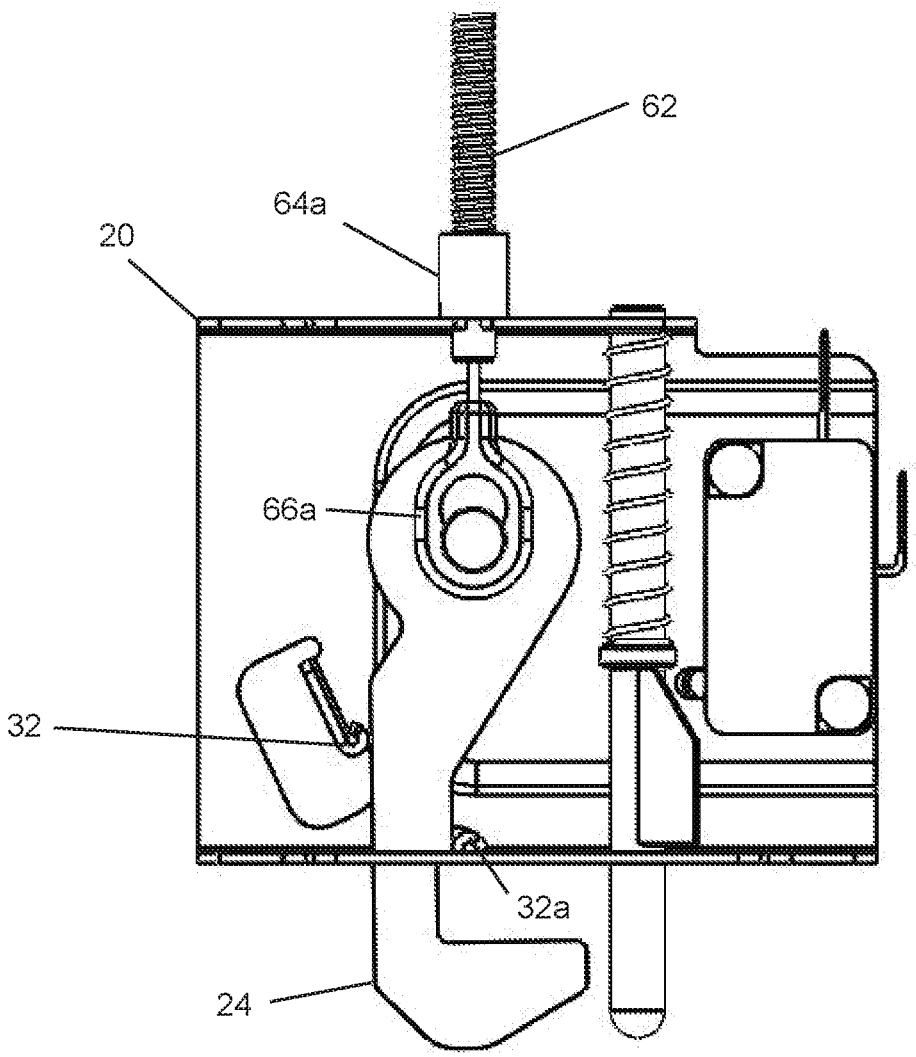
FIG. 12 is a perspective view of the latch and bracket assembly with hook guide features in an locking position in accordance with an exemplary embodiment of the present invention.

In the preferred embodiment, as indicated in FIG. 4, the latch bracket 20 includes a base surface 20*a* that is bolted or otherwise securely engaged with the appliance, and a front surface 20*b* and a back surface 20*c*, where the front and back surfaces 20*b*, 20*c* extend perpendicularly away from opposite ends of the base surface 20*a*. The hook guide 32 is preferably a projection that extends perpendicularly away from the base surface 20*a* of the latch bracket 20. The latch hook 24 includes an angled portion 24*a* that contacts the hook guide 32 when the latch hook 24 is being withdrawn by the cable assembly 14 to the locking position. The contact of the hook guide 32 with the angled portions 24*a* then urges latch hook 24 to pivot into engagement with the receptacle 30, thereby locking the door to the appliance. The unlocking and locking positions are shown in FIGS. 11 and 12, respectively. The latch hook 24 includes a hook portion 24*b* having a conventional hook-shape to engage the receptacle 30. The front surface 20*b* of the latch bracket 20 includes an aperture for admitting the latch hook 24 and the pivotal movement thereof. The front surface 20*b* includes a hook guide 32*a* for contacting the side of the angled portion 24*a* opposite from the hook guide 32, to assist in guiding the latch hook 24 in pivoting into the locking position. When pulling-in, guide 32 guides angled portion 24*c*. When returning to the unlocking position, guide 32*a* guides angled portion 24*a*.

As shown in FIGS. 1-3, a hook return spring 40 is configured to urge the latch hook 24 into the unlocking position. Upon actuation of the door latch 10, the cable assembly 14 is tensioned, causing the latch hook 24 to be withdrawn toward the back surface 20*c* of latch bracket 20, resulting in the latch hook 24 pivoting into the locking position, as described hereinabove. In the preferred embodiment (as also shown in detail in FIG. 4), the latch hook 24 also includes a cable attachment post 42 for connecting to a first end of a flexible cable of the cable assembly 14 (described in detail hereinbelow).

As further shown in FIGS. 1-3, the hook return spring 40 is positioned between the cable attachment post 42 and the back surface 20*c* of the latch bracket 20, to urge the latch hook 24 into the unlocking position. During tensioning, the cable attachment post 42 presses against the hook return spring 40, which is thereby compressed between the cable attachment post 42 and the back surface 20*c*. Upon deactuation of the door latch 10, when tension is released from the cable assembly 14, the compressed hook return spring 42 presses against the cable attachment post 42 and thus urge the latch hook 24 toward the front surface 20*b* of the latch bracket 20 and thereby into the unlocking position.

Figure 13:
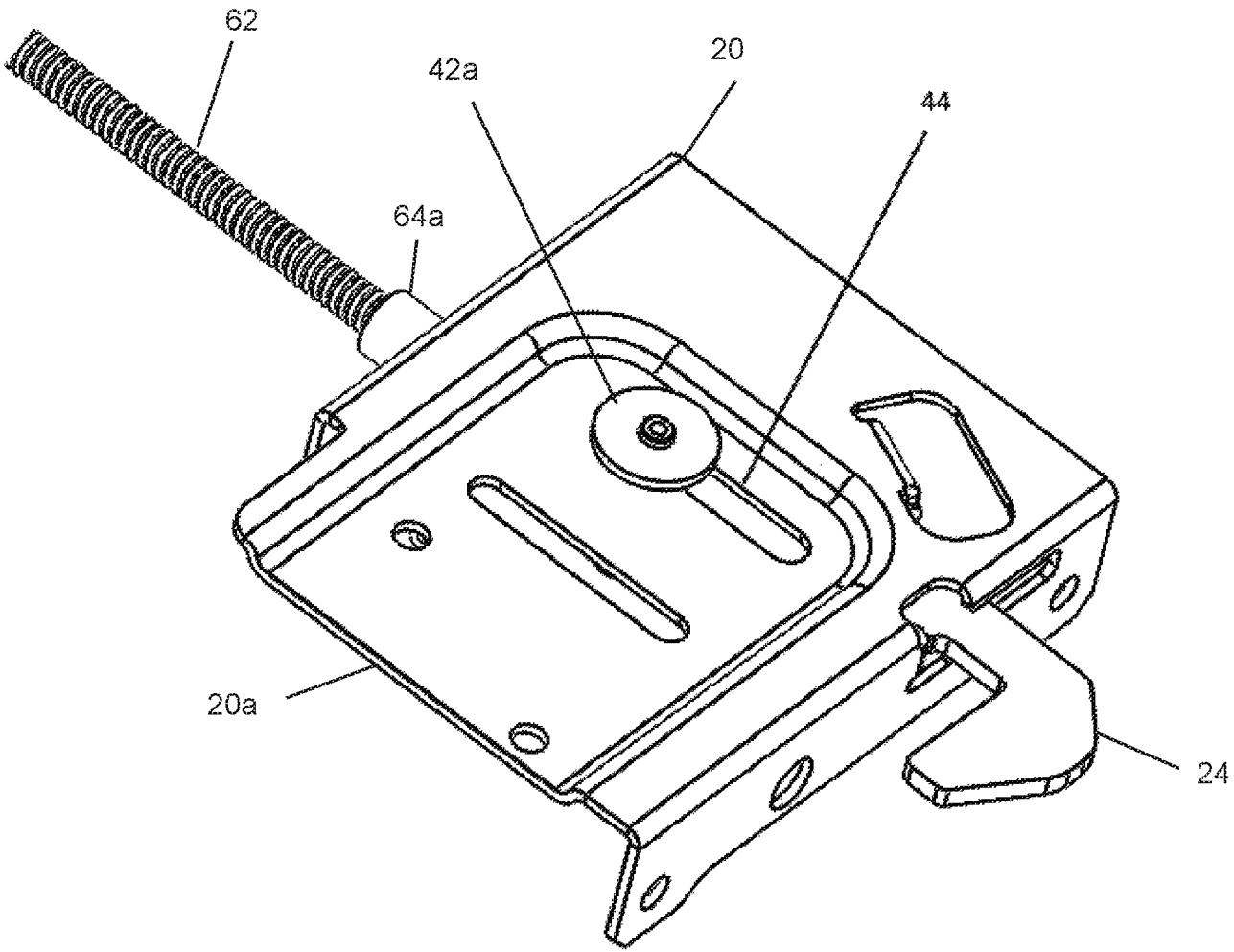
FIG. 13 is an inverted perspective view of the latch and bracket assembly in accordance with an exemplary embodiment of the present invention.
Figure 14:
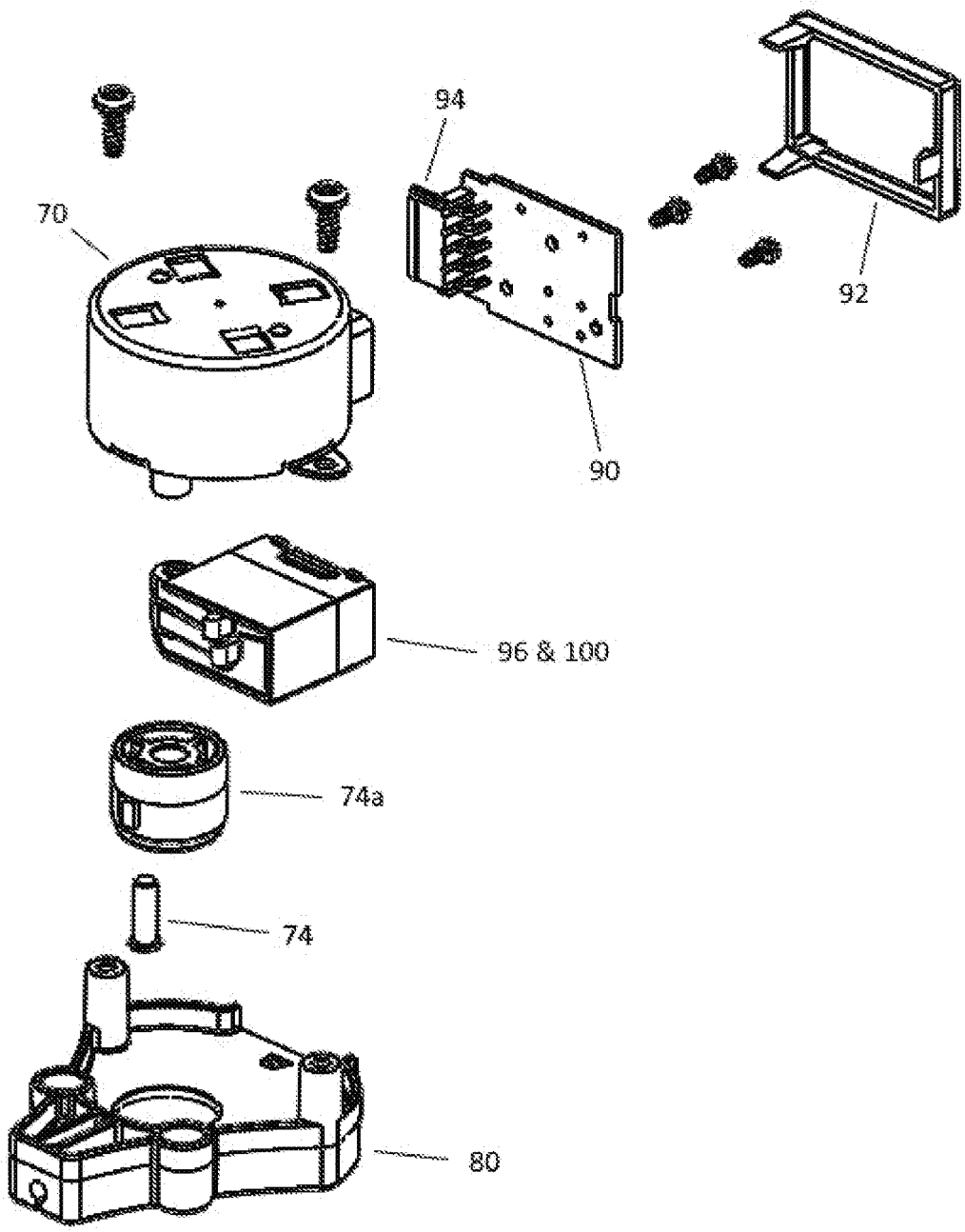
FIG. 14 is an exploded perspective view of the motor and bracket assembly with a single point connection in accordance with exemplary embodiments of the present invention.

As shown in FIG. 4, the latch bracket 20 further includes a groove 44, formed in the base surface 20*a*, in which the latch hook 24 is mounted for reciprocal movement between the locking position and the unlocking position. As also shown in FIG. 13, the cable attachment post 42 can include an extension that resides in the groove 44 and is secured underneath with a securement 42*a* that can include a type of nut and washer to ensure that the latch hook 24 is securely retained in the groove 44. Of course, it is to be appreciated that any other suitable type of securement 42*a* could alternately be employed without departing from the invention. The base surface 20*a* is defined by a raised portion to allow free and unencumbered movement of the securement when the latch bracket 20 is attached to the surface 22 of the appliance.

Figure 5:
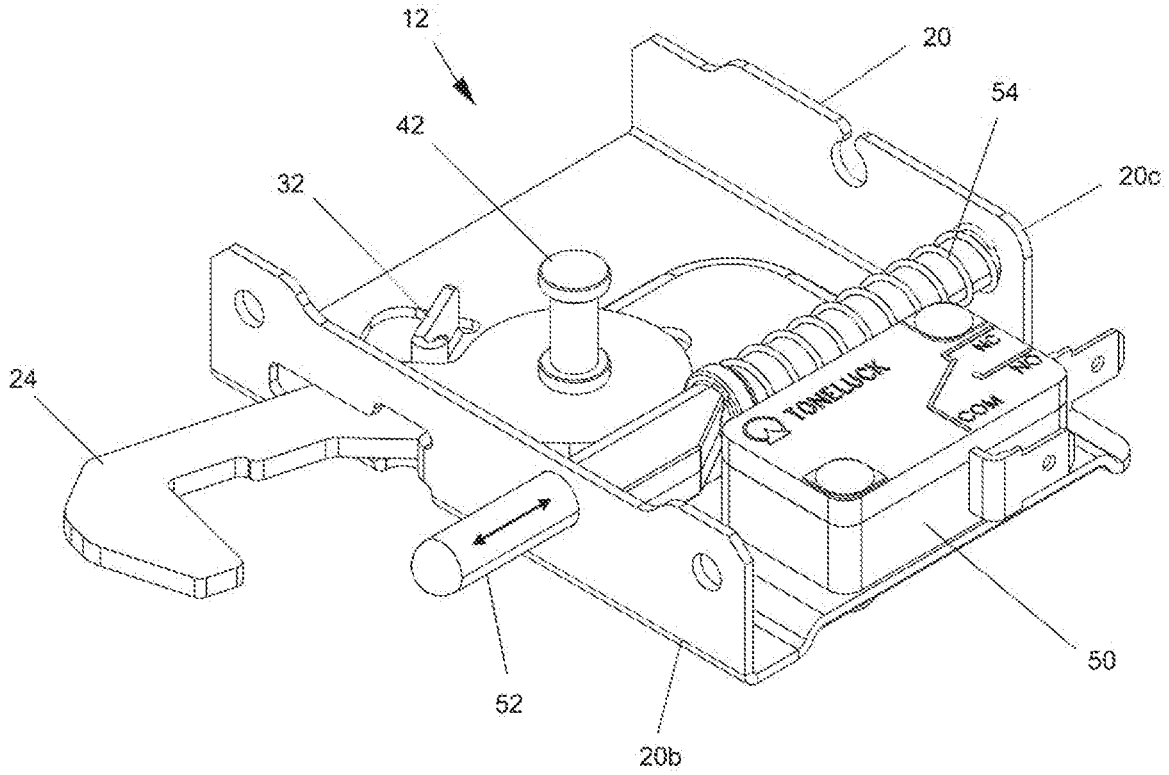
FIG. 5 is a perspective view of the latch and bracket assembly with an optional door switch and plunger feature in accordance with an exemplary embodiment of the present invention.
Figure 6:
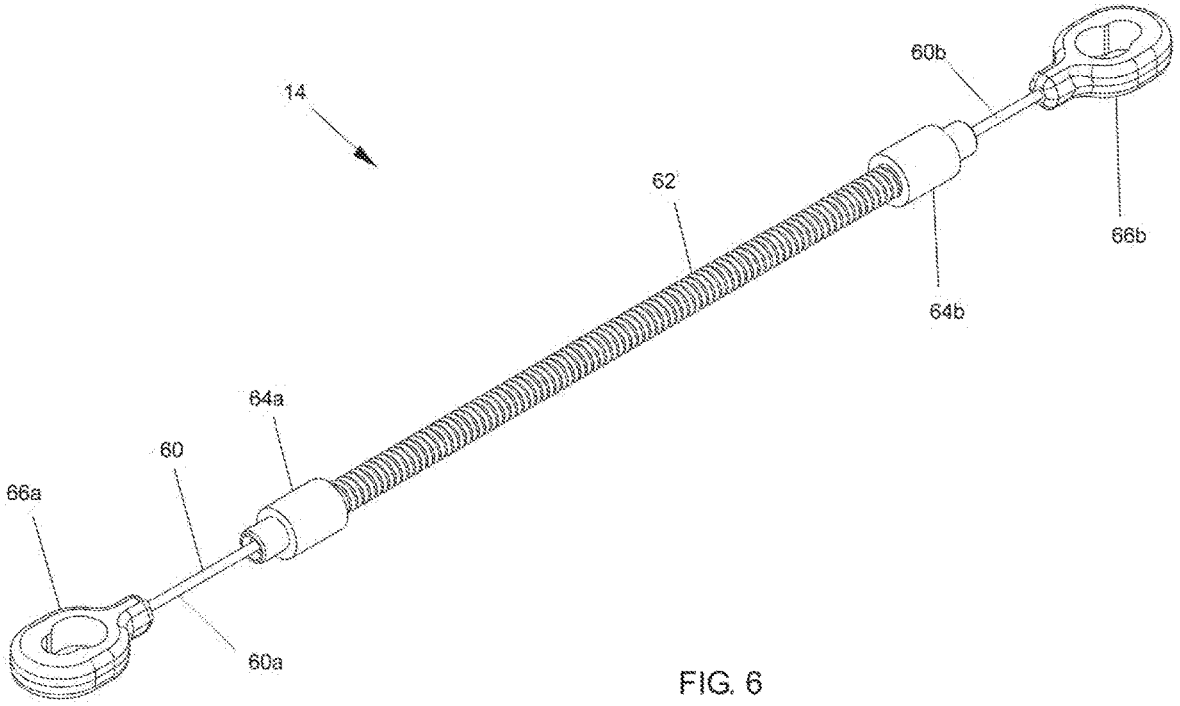
FIG. 6 is a perspective view of the cable assembly in accordance with an exemplary embodiment of the present invention.

FIG. 5 depicts a latch and bracket assembly in the form of a latch mechanism 12 having an optional door switch and plunger feature. A door switch 50 is used to indicate that the door is engaged with the appliance so that the latch hook 24 can be engaged. The door switch 50 generates a signal that communicates electronically to activate the motor and bracket assembly 16 to engage the latch hook 24, as will be explained in detail hereinbelow. A door switch actuator 52 fits through an opening in the front surface 20*b*. The door switch actuator 52 is depressed by contact with the door when closed upon the appliance, which then actuates the door switch 50, enabling the activation of the motor and bracket assembly 16. Depressing the door switch actuator 52 compresses an actuator return spring 54, which is placed between a sloped surface of the door switch actuator 52 and the back surface 20*c* of the latch bracket 20. When the door is opened again, compression is relied on the actuator return spring 54 which presses against the back surface 20*a* and the sloped surface of the door switch actuator 52 to displace the door switch actuator 52 to the original position, deactivating the door switch 50 until the next door closure.

FIGS. 1-3 and FIG. 6 depict the cable assembly 14 that connects to the latch mechanism 12 and also to the motor and bracket assembly 16. The cable assembly 14 includes a flexible cable 60 retained inside a flexible conduit 62. A first end 60*a* of the flexible cable 60 is connected to the latch hook 24 for displacing the latch hook 24 into the locking position for pivotal engagement with the receptacle 30. A second end 60*b* of the flexible cable 60 is connected to an actuator, as described in detail hereinbelow.

As also shown in FIGS. 1-3 and FIG. 6, the flexible conduit 62 is preferably formed from spirally wound wire enabling the flexible cable 60 free movement within the flexible conduit 62. In this manner, the flexible conduit 62 is under compression in the longitudinal direction of the cable assembly 14 when the flexible cable 60 is under tension, as when displaced by the actuator (as explained hereinbelow). This allows forces and operative movement from the actuator to be linearly transferred through the flexible cable 60 to the latch hook 24 for engagement with the receptacle 30 in the locking position.

As also shown in FIGS. 1-3 and FIG. 6, the flexible conduit 62 is terminated at each respective end of the cable assembly 14 with a first ferrule 64*a* and a second ferrule 64*b*. The first ferrule 64*a* is connected to the back surface 20*c* of the latch bracket 20 and the second ferrule 64*b* is connected to the motor and bracket assembly 16. These ferrules 64*a*, 64*b* hold the flexible conduit 62 securely in place and thereby allow the flexible cable 60 to slideably move within the flexible conduit 62. The first end 60*a* of the flexible cable 60 terminates with a first cable eyelet 60*a*, which is inserted over and retained by the cable attachment post 42. The second end 60*b* of the flexible cable 60 terminates with a second cable eyelet 60*b*, which is inserted over and retained by a crankshaft within the motor and bracket assembly 16, explained in detail hereinbelow.

As shown in FIGS. 1-3, an actuator (which is preferably the motor and bracket assembly 16) is connected to the second end 60*b* of the flexible cable for producing operative movement of the flexible cable 60 within the flexible conduit 62. This operative movement serves to displace the latch hook 24 between the locking position and the unlocking position through the interaction of the components of the latch mechanism 12, as described hereinabove. To wit, the flexible cable 60 is withdrawn, which pulls the latch hook 24 toward the back surface 20*c* of the latch bracket 20, so that the angled surface 24*a* of the latch hook 24 encounters the hook guide 32, causing the latch hook 24 to pivot into engagement with the receptacle 30.

As shown in FIGS. 1-3 and FIGS. 7-10, an actuator in the form of the motor and bracket assembly 16 includes a motor 70, which is preferably an electric motor. Upon actuation, the motor 70 rotates a motor shaft 72 (as especially shown in FIG. 8) which in turn rotates an eccentric crankshaft 74. The eccentric crankshaft 74 can be a cylinder 74*a* mounted concentrically onto the motor shaft 72. The eccentric crankshaft 74 includes a vertical post 74*b*, mounted perpendicular to the cylinder 74*a* and parallel to the motor shaft 72 as a position eccentrically displaced from the motor shaft 72. The vertical post 74*b* receives the second cable eyelet 66*b* and is therewith connected to the second end 60*b* of the flexible cable 60. In this manner, rotational movement of the eccentric crankshaft 74 is transformed into linear movement of the flexible cable 60 within the flexible conduit 62, thereby withdrawing the flexible cable 60 to produce the displacement of the latch hook 24 that results in engagement with the receptacle 30 as explained hereinabove.

Figure 15:
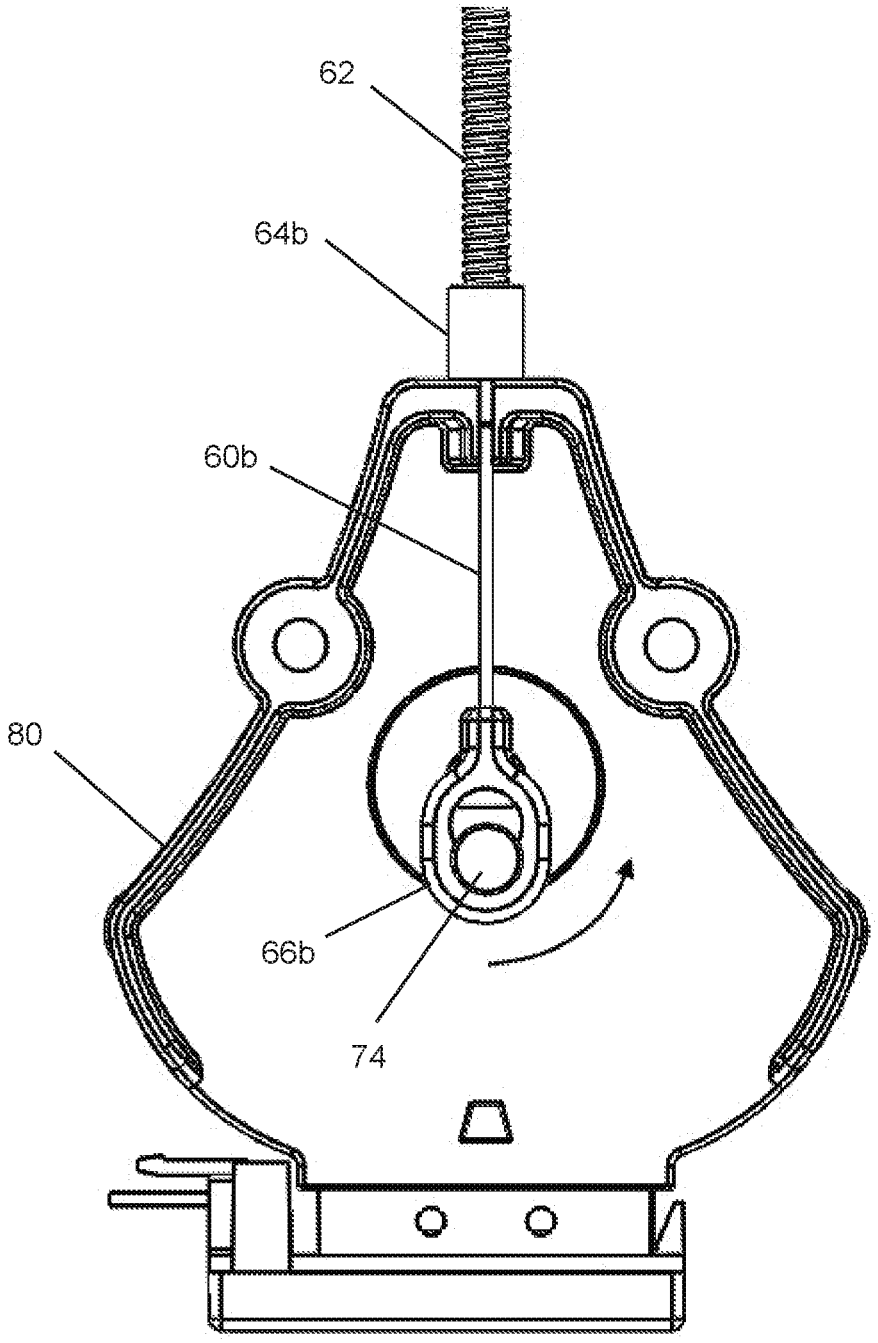
FIG. 15 is an inverted underside view of the motor bracket assembly with the motor removed and showing it in the locking position in accordance with an exemplary embodiment of the present invention.

FIGS. 15-17 depict various positions of the eccentric crankshaft 74 during rotation. In FIG. 15, the eccentric crankshaft 74 is displaced so that the flexible cable 60 is withdrawn and tensioned, engaging the latch mechanism 12 so that the latch hook 24 is pivoted to the locking position, as described hereinabove. In FIG. 16, the eccentric crankshaft 74 is in an intermediate position so that the flexible cable 60 is being released. In FIG. 17, the eccentric crankshaft 74 is displaced so that the flexible cable 60 is extended and the tension released, so that the latch mechanism 12 operates so that latch hook 24 is pivoted to the unlocking position, as also described hereinabove.

Figure 7:
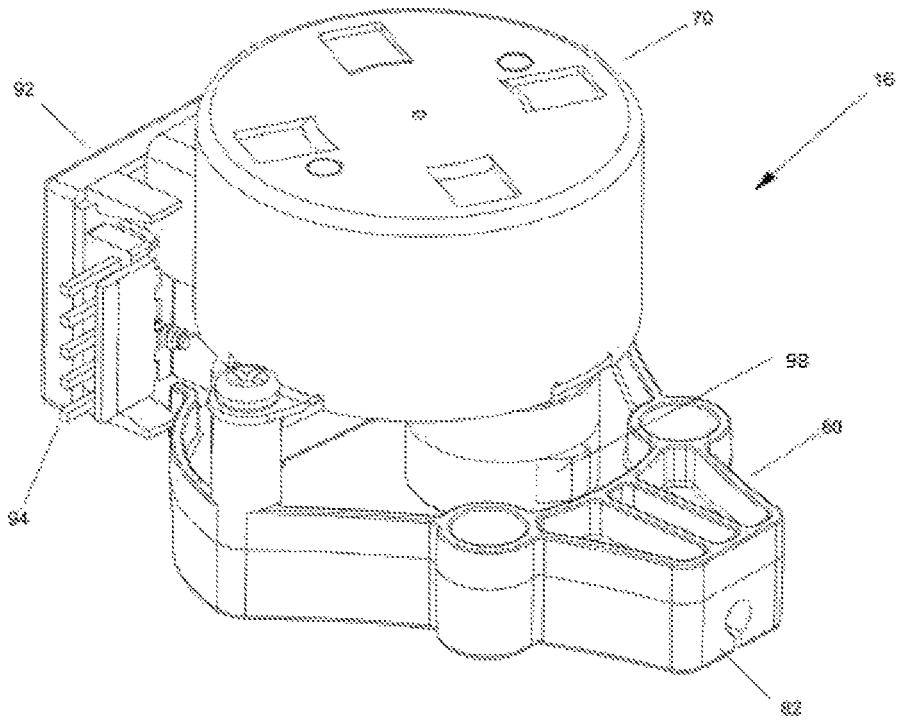
FIG. 7 is perspective view of the motor and bracket assembly with a single point connection in accordance with exemplary embodiments of the present invention.
Figure 8:
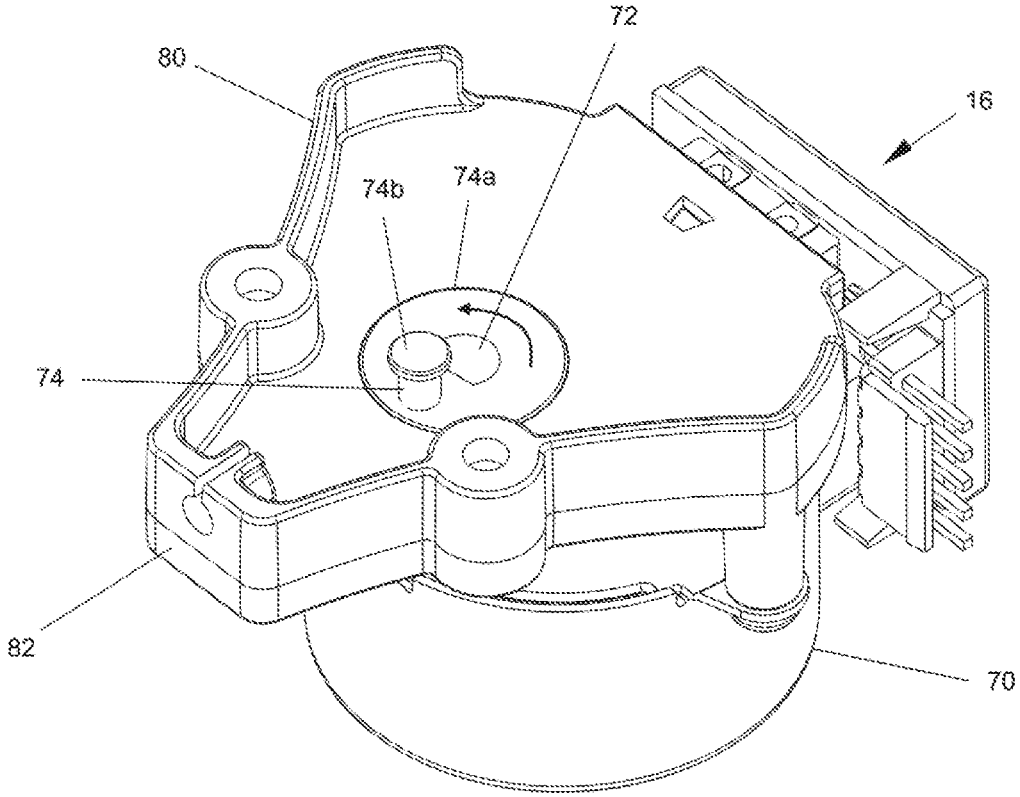
FIG. 8 is an inverted perspective view of the underside of the motor and bracket assembly showing the crankshaft in accordance with an exemplary embodiment of the present invention.

As particularly shown in FIGS. 7-10, the motor and bracket assembly 16 includes a bracket 80 for mounting to the appliance. As shown in FIGS. 1 and 3, the bracket 80 can mount to the same surface 22 as the latch mechanism 12 or it can mount to a different surface elsewhere within the appliance. The bracket 80 can mount with screws or any other suitable fasteners, as understood by those skilled in the art. As shown in FIG. 7, the motor 70 can be screwed or bolted to the bracket 80. As is apparent from FIGS. 7 and 8, the bracket 80 includes a passage 82 for engaging the second ferrule 64*b* and admitting the second end 60*b* of the flexible cable 60, to enable the second cable eyelet 66*b* to be looped over the vertical post 74*b* of the eccentric crankshaft 74.

Figure 9:
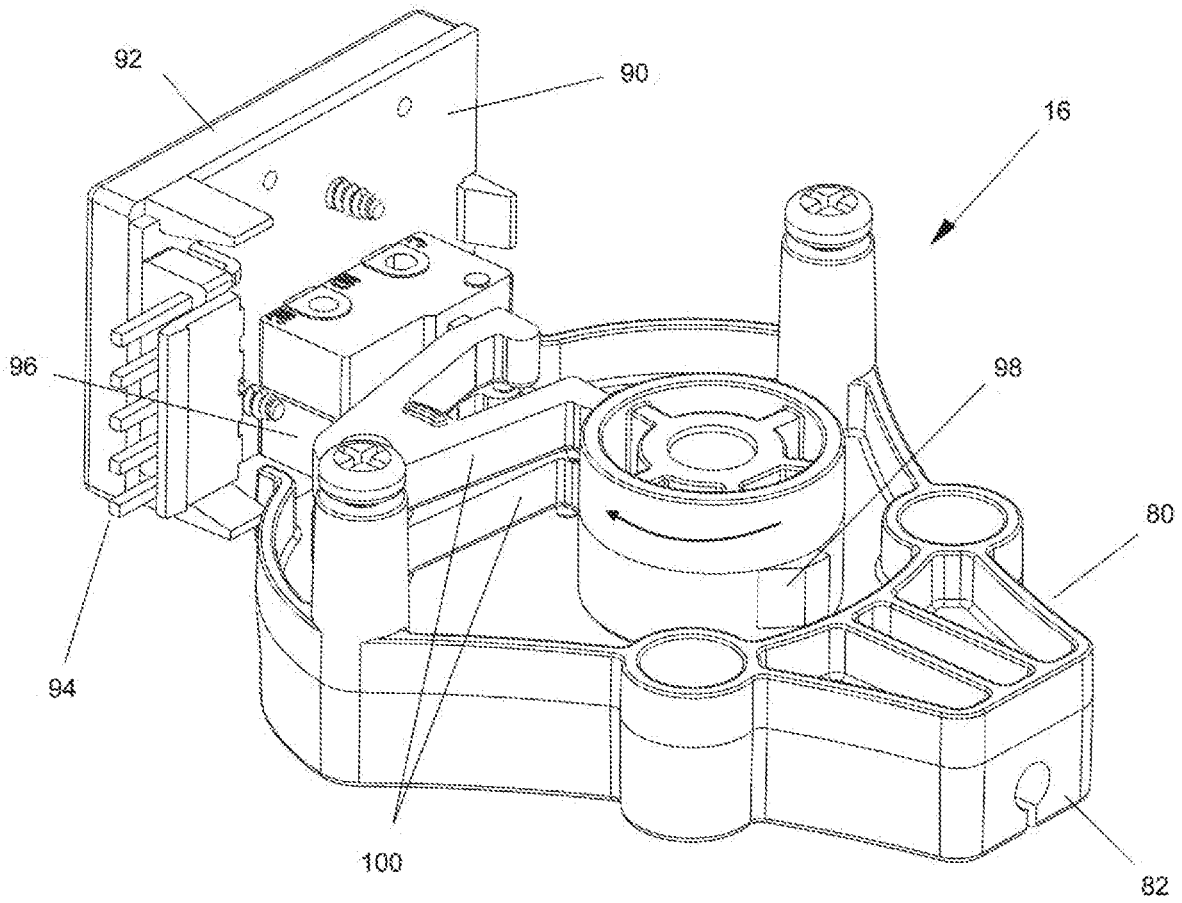
FIG. 9 is a perspective view of the motor bracket assembly with the motor removed in accordance with an exemplary embodiment of the present invention.
Figure 10:
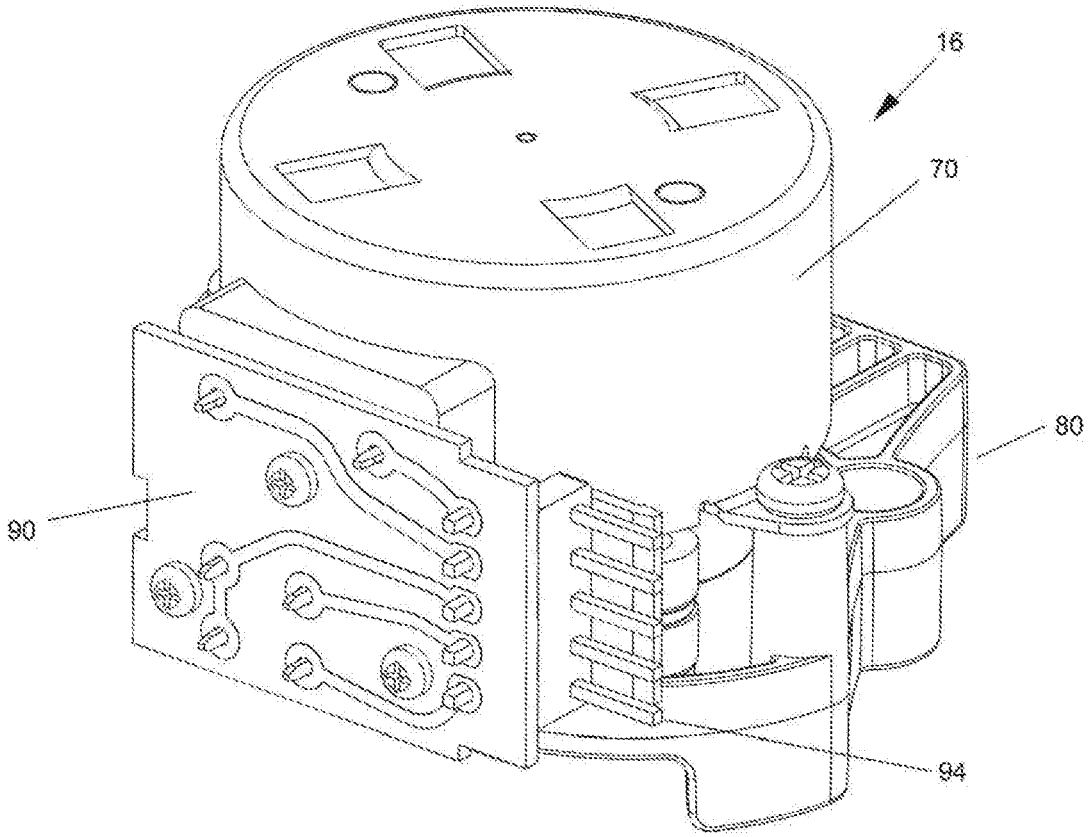
FIG. 10 is an alternate rear perspective view of the motor and bracket assembly with a single point connection in accordance with an exemplary embodiment of the present invention.

As particularly shown in FIGS. 9 and 10, the motor and bracket assembly 16 includes a circuit board 90 that that provides circuit paths for connection of switches 96 and the motor 70 to a single point connector 94. The circuit board 90 is covered by a circuit board cover 92. The cylinder 74*a* has at least one cam 98 for each switch 96. The cam 98 actuates a cam follower 100 which in turn depresses a button on switch 96. The cam 98 on cylinder 74*a* is angularly positioned with respect to crankshaft 74 to activate or deactivate the switch 96 to communicate to the oven's controller the position of the latch hook 24. The oven's controller uses the switch status (open or closed circuit) to control the use of the oven's self-clean function. A latch is engaged with the oven door prior to allowing the self-clean function to commence. The door switch 50 communicates door open or door closed status to the oven's controller. If the door is open, the switch status will preclude actuation of the latch; conversely, if the door is closed, the door switch will communicate door position status and the controller will then actuate the latch.

As shown in the figures, in the preferred embodiment, the present door latch 10 locks a cooking oven door during an oven self-clean cycle. The door latch 10 incorporates the electric motor 70 having the eccentric crankshaft 74 connected to the second end 60*b* of the flexible cable 60. The first end 60*a* of the flexible cable 60 is connected to the latch mechanism 12 which causes the pivoting latch hook 24 to engage an oven door during a self-clean locking event. The flexible cable 60 converts the rotational movement of the motorized crankshaft 74 into linear movement of the flexible cable 60. The flexible cable 60 operates inside of the flexible conduit 62 formed from spirally wound wire. The longitudinal direction of the flexible conduit 62 is under compression when the flexible cable 60 is under tension, thus allowing the forces and movement of the crankshaft 74 to be linearly transferred to the latch hook 24.

Due to the flexible nature of the cable 60 and conduit 62, the cable assembly 14 can be routed (snaked) through narrow passages between inner and outer walls of the oven appliance. The conduit 62 protects the movement of the inner cable 60 from contact with insulation and other oven componentry. Further, the cable assembly 14 can preferably be made of materials suitable for high temperature operation without adverse operational concern and it can transfer excellent door pull-in force. The small cable diameter and flexible routing options optionally enables the manufacture of ovens having enlarged oven cavities without encroaching on the space allocated for prior art linkage-type latch systems. Gaining space with an enlarged oven cavity within the standard envelope of an oven represents a benefit to end users desiring greater oven space for cooking, and a marketing advantage for the manufacturer.

The flexible nature of the present cable assembly 14 allows for the motor 70 with the eccentric crankshaft 74 to be mounted in convenient cool operational areas within the oven appliance. Further, the cooler operational temperatures allow the latch assembly 12 to be manufactured with low-cost motor technologies, such as low voltage DC motors, which in turn can enable the incorporation of low cost wiring options, resulting in lower manufacturing cost.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

What is claimed:

1. A door latch comprising:

a latch mechanism, secured to an appliance, that locks a door to the appliance, wherein the latch mechanism comprises:

a latch bracket mounted to a surface of the appliance;

a latch hook mounted within the latch bracket for pivotal and reciprocal movement between a locking position and an unlocking position, wherein the latch hook pivotally engages a receptacle mounted on the door, to pull-in and lock the door to the appliance;

a hook guide configured to pivotally urge the latch hook into engagement with the receptacle when the latch hook is moved to the locking position;

a hook return spring configured to urge the latch hook into the unlocking position;

a flexible cable retained inside a flexible conduit, wherein a first end of the flexible cable is connected to the latch hook for displacing the latch hook into the locking position for pivotal engagement with the receptacle; and an actuator connected to a second end of the flexible cable for producing operative movement of the flexible cable within the flexible conduit to displace the latch hook between the locking position and the unlocking position.

2. The door latch of claim 1, wherein the latch bracket further comprises a groove in which the latch hook is mounted for reciprocal movement between the locking position and the unlocking position.

3. The door latch of claim 1, wherein the latch hook further comprises a cable attachment post for connecting to the first end of the flexible cable, and wherein the hook return spring is positioned between the cable attachment post and a back surface of the latch bracket to urge the latch hook into the unlocking position.

4. The door latch of claim 1, wherein the hook guide is mounted to the latch bracket at a position to contact the latch hook during reciprocal movement to the locking position, to pivotally urge the latch hook into engagement with the receptacle.

5. The door latch of claim 1, wherein the flexible conduit is formed from spirally wound wire enabling the flexible cable free movement within the flexible conduit such that the flexible conduit is under compression in a longitudinal direction when the flexible cable is under tension, thus allowing forces and operative movement from the actuator to be linearly transferred to the latch hook.

6. The door latch of claim 1, wherein the actuator comprises an electric motor which rotates an eccentric crankshaft connected to the second end of the flexible cable so that rotational movement of the eccentric crankshaft is transformed into linear movement of the flexible cable within the flexible conduit.

7. The door latch of claim 1, wherein the actuator comprises a bracket for mounting to the appliance.

8. The door latch of claim 1, wherein the appliance is a self-cleaning oven.

9. A door latch comprising:

a latch mechanism, secured to an appliance, that locks a door to the appliance, wherein the latch mechanism comprises:

a latch bracket mounted to a surface of the appliance;

a latch hook mounted within the latch bracket for reciprocal movement between a locking position and an unlocking position, wherein the latch hook pivotally engages a receptacle mounted on the door, to lock the door to the appliance;

a hook guide configured to pivotally urge the latch hook into engagement with the receptacle when the latch hook is moved to the locking position;

a hook return spring configured to urge the latch hook into the unlocking position;

a flexible cable retained inside a flexible conduit, wherein a first end of the flexible cable is connected to the latch hook for displacing the latch hook into the locking position for pivotal engagement with the receptacle; and an electric motor connected to a second end of the flexible cable for producing operative movement of the flexible cable within the flexible conduit to displace the latch hook between the locking position and the unlocking position.

10. The door latch of claim 9, wherein the electric motor comprises a circuit board that provides circuit paths for connection of at least one switch and the electric motor to a single point connector.

11. The door latch of claim 9, wherein the electric motor comprises a cylinder, at least one cam on the cylinder, a switch with a button connected to a circuit board, and at least one cam follower disposed between the cylinder and the switch with the button so that the cylinder and the at least one cam move to contact the at least one cam follower so that the at least one cam follower contacts the button on the switch, wherein the at least one cam on the cylinder is angularly positioned with respect a crankshaft sitting on top of the cylinder so as to activate or deactivate the switch to communicate to the circuit board a position of the latch hook.

* * * * *